United States Patent [19]

Putch

[11] Patent Number: 4,773,477

[45] Date of Patent: Sep. 27, 1988

[54] WELL SUSPENSION ASSEMBLY

[75] Inventor: Samuel W. Putch, Houston, Tex.

[73] Assignee: Norman A. Nelson, Houston, Tex. ; a part interest

[21] Appl. No.: 29,837

[22] Filed: Mar. 24, 1987

[51] Int. Cl.[4] ..... E21B 23/02; E21B 33/04; E21B 19/10

[52] U.S. Cl. ..... 166/206; 166/208; 166/217; 285/141

[58] Field of Search ..... 166/206, 208, 217, 348; 285/140-143

[56] References Cited

U.S. PATENT DOCUMENTS

| | | | |
|---|---|---|---|
| 2,737,248 | 3/1956 | Baker | 285/141 |
| 2,849,245 | 8/1958 | Baker | 285/141 |
| 3,420,308 | 1/1969 | Putch | 166/208 |
| 3,893,717 | 7/1975 | Nelson | 285/3 |
| 4,422,507 | 12/1983 | Reimert | 166/348 |
| 4,469,172 | 9/1984 | Clark | 285/141 |
| 4,607,865 | 8/1986 | Hughes | 285/141 |
| 4,641,708 | 2/1987 | Wightman | 166/208 |
| 4,665,979 | 5/1987 | Boehm, Jr. | 166/208 |

*Primary Examiner*—Jerome Massie, IV
*Assistant Examiner*—Bruce M. Kisliuk
*Attorney, Agent, or Firm*—Fulbright & Jaworski

[57] ABSTRACT

An assembly for connecting an inner and an outer tubular member to and from each other in a well. A resiliently expandable and contractible locking support element is carried by and is axially slidable on the inner member. Two or more radially outwardly extending and downwardly facing load bearing support shoulders and peripheral locking surfaces are positioned on the inner member and coact with inwardly facing load bearing shoulders and locking surfaces on the locking support element. Two or more radially outwardly facing load bearing support shoulders on the locking support element coact with mating load bearing support shoulders on the inside of the outer tubular member. A release initially prevents axial movement of the locking support element on the inner member and may be positioned above, below or intermediate the ends of the locking support element. The locking support element may be an integral unit or a plurality of multiple separate units. The locking support element may be biased outwardly by various types of spring devices.

8 Claims, 5 Drawing Sheets

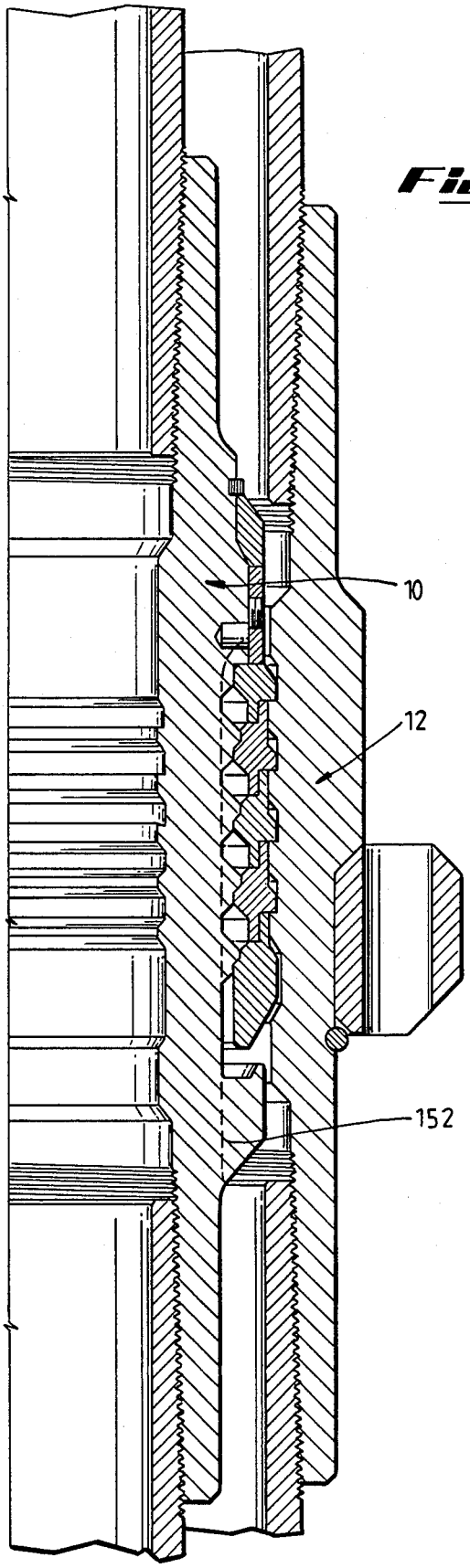
Fig.4A
Fig.4B
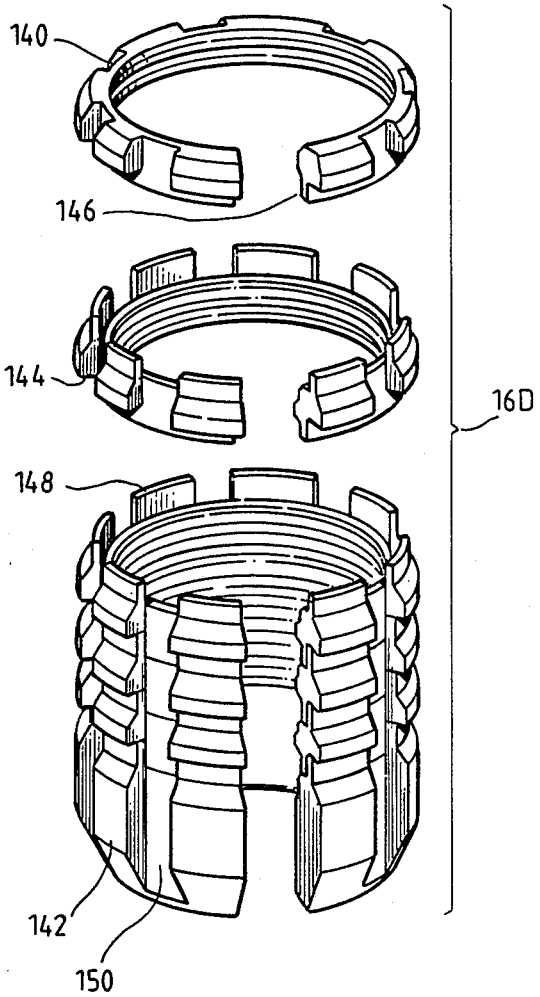

WELL SUSPENSION ASSEMBLY

BACKGROUND OF THE INVENTION

It is known, as shown in U.S. Pat. Nos. 3,420,308, 3,893,717, and 4,422,507 to support an inner member in a well from an outer member by means of a resilient expandable and contractible locking support element. However, the annular space between the inner and outer tubular members in a well in which the necessary load bearing surfaces must be provided is limited.

The present device is directed to various improvements in an assembly for connecting inner and outer tubular members together by means of a resilient expandable and contractible locking support element mounted on the inner tubular member which is biased radially outwardly but free to expand and contract radially until it engages a mating profile in the outer tubular member. After engagement a releasable means permits the locking support element to move axially with respect to the inner tubular member to a locked expanded position and support the weight of the inner tubular member on the outer tubular member. By providing two or more coacting load bearing shoulders between the inner tubular member and the locking support element and two or more coacting load bearing shoulders between the outer tubular member and the locking support element a greater area of load bearing surfaces can be provided in a limited annular space.

SUMMARY

The present invention is directed to a load supporting or hanger assembly for releasably connecting inner and outer tubular members, such as casings or other well members, together. The assembly includes a resiliently expandable and contractible locking support element radially and axially movable on the inner tubular member for engagement with the outer tubular member. Two or more load bearing support shoulders and locking surfaces are provided between the inner member and locking support element, positioned for aligning and guiding the locking support element from a contracted non-engaging position to an expanded and locked engaged position, and two or more load bearing support shoulders are provided between the locking support element and the outer tubular member.

Still a further object of the present invention is the provision of a releasable holding means for initially preventing axial movement of the locking support element with respect to the inner member until the locking support element expands and engages the outer member. The releasable means may be positioned above, below or intermediate the ends of the locking support element.

Yet a further object is wherein the locking support element may be an integral member or a plurality of separate members and can be resiliently biased by various types of springs.

Still other and further objects, features and advantages will be apparent from the following description of presently preferred embodiments of the invention, given for the purpose of disclosure and taken in conjunction with the accompanying drawings.

BRIEF DESCRIPTION OF THE DRAWINGS

FIG. 2B shows the locking support element expanded into engagement with the mating grooved profile in the outer tubular member, FIG. 2C shows the expanded locking support element in an expanded and locked supporting position, FIG. 3A is a prior art assembly showing a locking support element with a single load bearing shoulder and locking surface with respect to it and an inner hanger body and a single load bearing support shoulder between it and the outer hanger body, FIG. 3B is another prior art assembly with one support shoulder between the locking support element and the inner hanger body but with two locking surfaces between the locking support element and the inner pipe hanger body and three support shoulders between the locking support element and the outer hanger body, FIG. 3C is a fragmentary elevational view, partly in cross section, of one version of the present invention showing multiple load bearing support shoulders and locking surfaces between the locking support element and the inner pipe hanger and multiple support shoulders between the locking support element and the outer pipe hanger, FIG. 4A is a fragmentary elevational view, partly in cross section, of another embodiment of the present invention, showing the locking support element consisting of separate multiple stacked C-ring elements and in its locked load bearing position, FIG. 4B is a perspective view of the locking support element shown in FIG. 4A, showing two of the C-ring elements separated from the main cluster of the locking support element.

DESCRIPTION OF THE PREFERRED EMBODIMENTS

While the present invention will be described, for purposes of illustration only, as used in a mudline casing hanger assembly, the present well suspension assembly is also useful in other applications in suspending an inner tubular member from an outer tubular member in a well such as subsea wellheads, through bore surface well heads, and downhole well tools such as line hangers and well packers.

Figure 1:
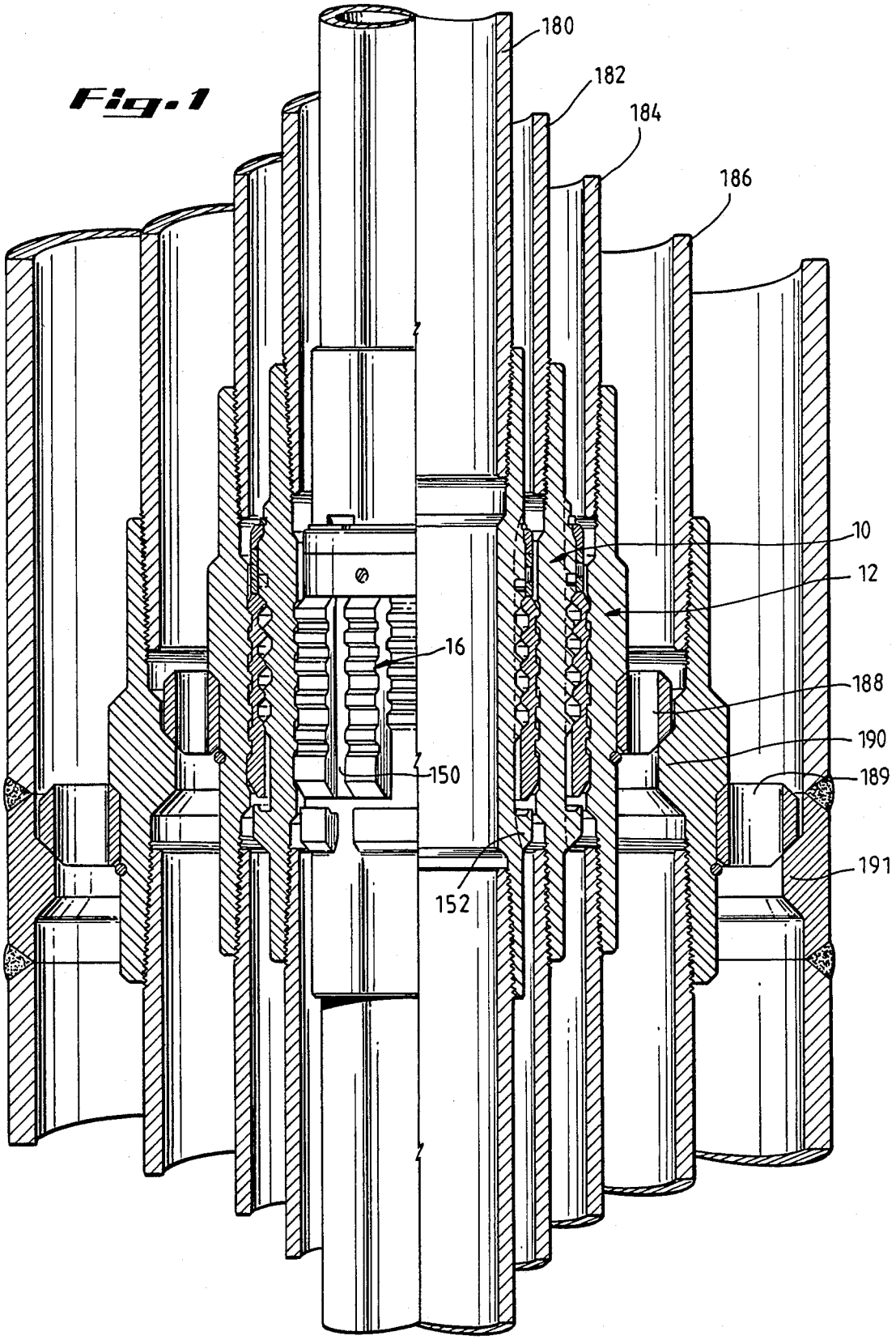
FIG. 1 is an elevational view, partly in cross section, of five pipe or casing strings with each inner string supported on the next outer string and with the two inner most strings supported by the assembly of the present invention including an expandable and contractible locking support element with multiple load bearing support shoulders on both the inner and outer surface of the locking support element.

Referring now to FIG. 1, a mudline or downhole casing support system is shown having a plurality of concentric casing strings, here shown as five, with each inner string supported on the next outer string. The inner most casing string 180 is supported from the next outer casing string 182 by one embodiment of the well suspension assembly of the present invention. Similarly, casing 182 is likewise supported by an assembly of the present invention from the next outer casing string 184. However, casing string 184 and casing string 186 are each supported on the next outer casing string by outward radially extending shoulders 188 and 189, respectively, resting on inwardly radially extending shoulders 190 and 191, respectively, of the next outer casing string.

One embodiment of the present invention, such as the well suspension assembly between the casings 182 and 184, will be described in which the inner casing 182 is connected to an inner tubular member or inner casing hanger 10 which is adapted to be connected to and released from an outer tubular member or the casing hanger 12 connected to the casing 184.

Figure 2C:
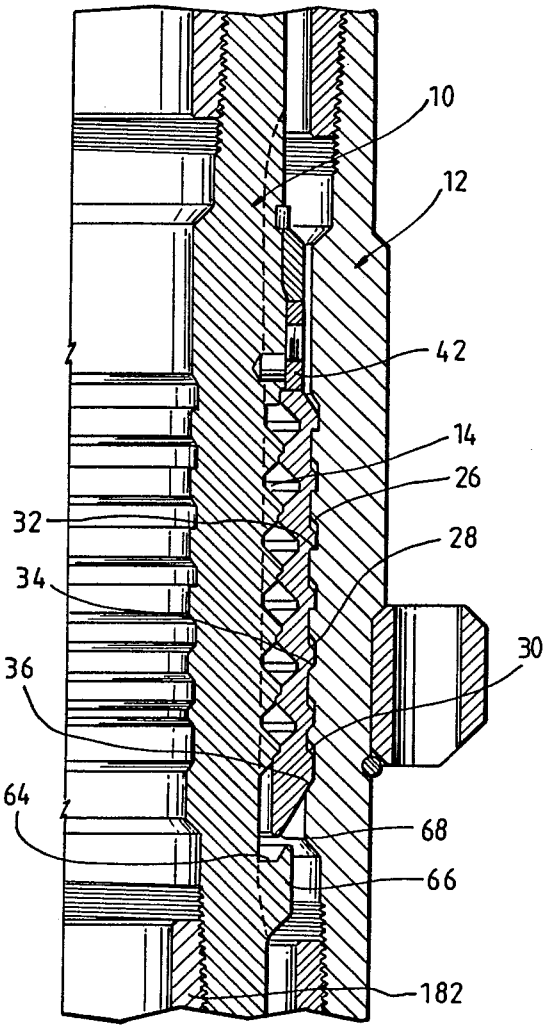
FIGS. 2A, 2B and 2C are fragmentary elevational views, partly in cross section, of the assembly of the present invention showing three positions of the locking support element as the inner tubular member is being run in an outer tubular member with FIG. 2A showing the locking support element of the hanger in the collapsed or contracted position.
Figure 2B:
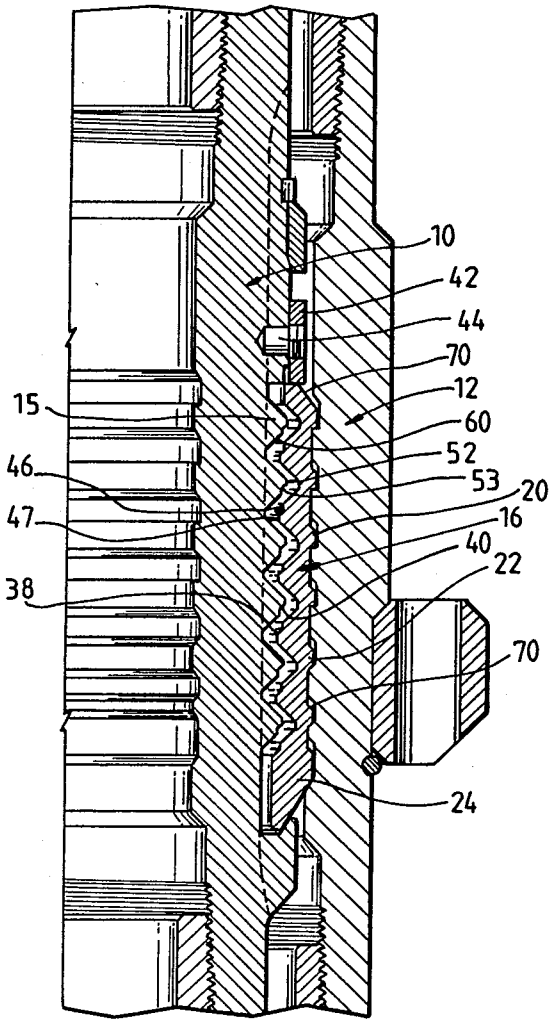
Figure 2A:
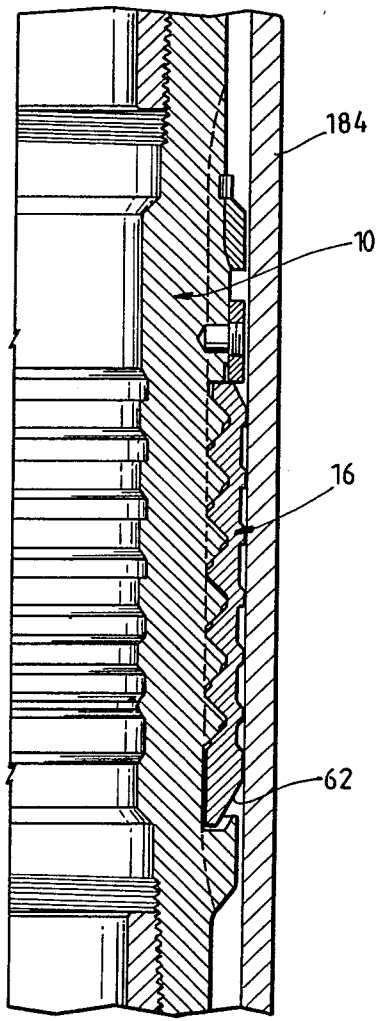

Referring now to the drawings and particularly FIGS. 2A, 2B and 2C, an inner casing hanger 10 is shown which is desired to be connected to and releasable from an outer casing hanger 12, both of which are tubular members in which the inner casing hanger 10 may be supported, suspending a string of casing in a well, from the outer casing hanger 12. The casing hanger assembly 10 generally includes a plurality of load bearing or support shoulders 15 and annular recesses 14 in its outer peripheral surface for carrying an expandable outwardly biased and resiliently contracting locking support element, generally indicated by the reference numeral 16. The locking support element 16, a resiliently expandable and contractible C-shaped ring circumscribing inner casing hanger 10, is normally biased and urged to an expanded position but will yieldingly collapse into the recesses 14 when the casing hanger 10 is being run inside a restricted diameter such as well casing 184 as shown in FIG. 2A.

When the inner casing hanger 10 is opposite the outer casing hanger 12, as shown in FIG. 2B, the locking support element 16 includes a plurality of outwardly and downwardly facing load bearing or support shoulders 20, 22 and 24, which expand into mating notches or grooves 26, 28, 30 on the inner periphery of the outer casing hanger 12.

Each of the grooves 26, 28 and 30 includes a mating load bearing shoulder. Grooves 26 each include a load bearing shoulder 32, grooves 28 each include a load bearing shoulder 34 and groove 30 includes a load bearing shoulder 36. At least one of the upwardly facing and mating load bearing shoulders should be of an angle such as substantially right angles to the axis of the casing shown by shoulders 32 in grooves 26, in order to provide a substantially positive stop against further downward movement of the locking support element 16 when engaged with mating load bearing shoulders 20 on the locking support element 16.

As shown in FIG. 2B, as the inner hanger 10 is lowered, its weight is transferred to the top of expanded locking support element 16 by means of a release ring 42 that is attached to inner casing hanger 10 by means of one or more shear pins 44. When the load between the release ring 42 and the top of the locking support element 16 exceeds the strength of the shear pins 44, they shear, permitting the inner hanger 10 to move down with respect to both the release ring 42 and the locking support element 16, until upwardly facing load bearing shoulders 38 on the inside diameter of locking support element 16 engage coacting downwardly facing load bearing shoulders 40 on shoulders 15 on the outside diameter of inner hanger 10 as shown in FIG. 2C. These mating shoulders 38 and 40 (as well as the other load bearing support shoulders described) may be at right angles to the axis of the hanger or may be at any angle that provides mating load bearing shoulders as shown in FIGS. 2A, 2B and 2C. The weight of the inner casing 182 attached to inner casing hanger 10 is now supported on load bearing shoulders 40 which in turn bear against the upwardly facing load bearing shoulders 38 on locking support element 16 which in turn is supported by its outwardly and downwardly facing support shoulders 20, 22 and 24 bearing against the upwardly facing load bearing surfaces 32, 34 and 36 at the bottom of circumferential grooves 26, 28 and 30 respectively on the inside of outer hanger body 12. When the elements are in this supported position inwardly facing locking surfaces 46 and 47 of locking support element 16 bear against outwardly facing locking surfaces 52 and 53, respectively of load bearing shoulders 15 on inner casing hanger 10 thereby forcing the locking support means 16 to remain expanded into engagement with the grooves 26, 28 and 30 in outer casing hanger 12. Downwardly facing tapered surfaces 60 are provided on the load bearing shoulders 15 of inner casing hanger 10 for forcing the locking support element 16 to move radially outward in the event the normal outwardly biasing forces acting on locking support element 16 are not sufficiently strong to force the support shoulders 20, 22 and 24 completely into the grooves 26, 28 and 30. These grooves may contain materials such as formation cuttings, mud or cement which must be displaced.

An outwardly and downwardly facing surface 62 is provided on lower most shoulder 24 on locking support element 16 for forcing the entire locking support element 16 to collapse as it is lowered (FIG. 2A) into a reduced diameter section in the outer casing 184 such as might be encountered when running through blow out preventers and well head assemblies connected to the outer casing. This lower shoulder 24 is normally longer than the other support shoulders 20 and 22 to assure that locking support element 16 will not expand into the grooves in casing hanger 12 until all shoulders and grooves are matching. Also by having different length lower support shoulders 24 and mating grooves 30 and by having the shortest length groove in an upper casing hanger 12, a locking support element 16 with a lower support shoulder 24 longer than the length of the key groove 30 in upper outer casing hanger 12 will pass through the upper casing hanger 12 without expanding into its support grooves but will expand only into a casing hanger 12 with mating grooves. If desired, this key effect to permit running an inner casing hanger 10 through an upper casing hanger 12 could also be achieved by staggering the spacing between the other support shoulders so that only matching assemblies will mate together.

To disconnect the inner casing hanger 10 from the outer casing hanger 12, it is only necessary to pull up on the inner hanger body 10 which moves it axially with respect to expanded locking support element 16 until an upper horizontal surface 64 of outwardly protruding shoulder 66 on inner hanger body 10 engages the bottom most surface 68 on locking support element 16 which is the same relationship as shown in FIG. 2B. Continued upward movement of the inner hanger assembly causes the downwardly tapering shoulders 70 on locking support element 16 to force the entire locking support element 16 into a collapsed position as shown in FIG. 2A when these shoulders 70 engage a reduced diameter, thereby permitting upward removal of the inner casing and hanger assembly 10 from the outer casing hanger assembly 12.

Figure 3A:
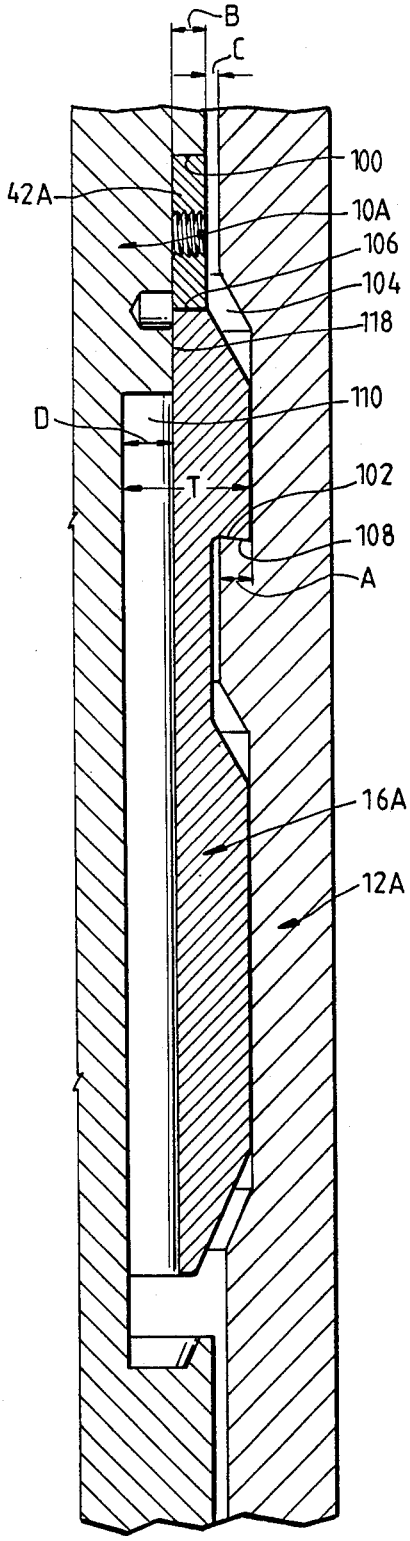
Fig. 3A (PRIOR ART)
FIGS. 3A, 3B and 3C are fragmentary elevational views, partly in cross section of two prior art assemblies and an embodiment of the present invention, respectively, shown for comparison purposes, and with each of the locking support elements in its expanded and locked load bearing position.
Figure 3B:
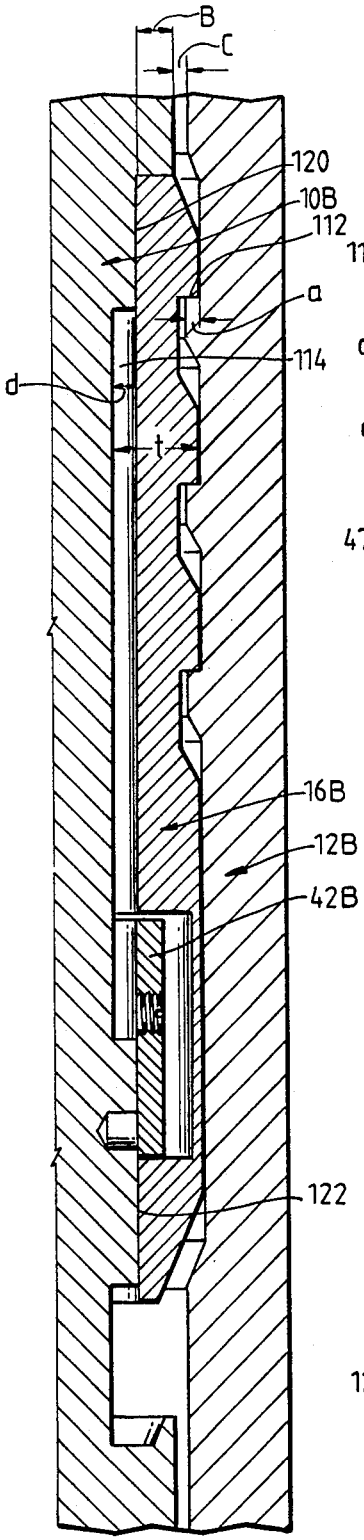
Fig. 3B (PRIOR ART)
Figure 3C:
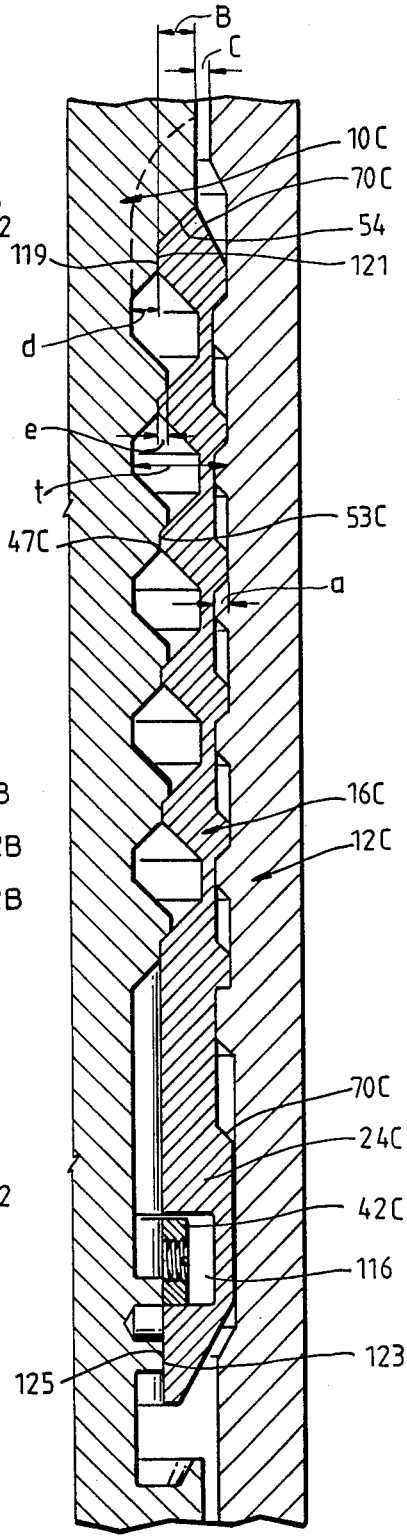

Referring now to FIGS. 3A, 3B and 3C, an embodiment of the present invention, shown in FIG. 3C, is compared with prior art structures of FIGS. 3A and 3B. FIG. 3A is generally similar to U.S. Pat. No. 3,420,308; FIG. 3B is generally similar to a commercial embodiment of U.S. Pat. No. 3,893,717. Similar parts in FIGS. 3A, 3B and 3C that correspond to parts in FIGS. 2A, 2B and 2C are similarly numbered with the addition of the suffix "A", "B" and "C", respectively.

The problem in well suspension assemblies is that the annular space between the inner tubular member and the outer tubular member, T in FIG. 3A, and t in FIGS. 3B and 3C, is quite limited and it is therefore difficult to design a suspension assembly having the necessary load bearing shoulders with areas sufficient to carry heavy loads.

The assembly shown in FIG. 3A has one load bearing shoulder 100 and one locking surface 118 on the outer circumference of inner hanger body 10A and one load bearing shoulder 102 at the bottom of groove 104 in the inner circumference of outer casing hanger 12A and a locking support element 16A with one upwardly facing load shoulder 106 and one downwardly facing load bearing shoulder 108. Assuming that the strength of all of the materials is equal, it can be seen that the areas of the load bearing surfaces must also be substantially equal, so that radial distance "B" is approximately equal to radial distance "A". If clearance "C" is equal to $\frac{1}{3}$ "A" then it can be seen that the radial distance "D" of recess 110 must be equal to $1\frac{1}{3}$ "A" in order to permit locking support element 16A to collapse to the outside diameter of 10A and that the total radial distance T from the bottom of recess 110 to the outer diameter of groove 104 must equal $3\frac{2}{3}$ "A".

Now referring to FIG. 3B, the number of load bearing shoulders between locking support element 16B and outer hanger 12B has been increased to three and there are two locking surfaces 120 and 122 on inner hanger body 10B. Since the materials used in FIGS. 3A, 3B and 3C are the same strength then it is apparent that the radial length of "a" of shoulder 112 need only be approximately $\frac{1}{3}$ the length of "A" of shoulder 102 in FIG. 3A. The radial distance "d" of recess 114 must be equal to "a" plus "C", each of which equals $\frac{1}{3}$ "A", so that "d" equals $\frac{2}{3}$ "A" and "t" equals $2\frac{1}{3}$ "A". Thus it can be seen that the assembly in FIG. 3B has approximately the same strength as the assembly in FIG. 3A but its total radial distance "t" is only 7/11 that of "T".

FIG. 3C is a modified version of the present invention with the locking support element 16C fully expanded into grooves in outer hanger body 12C and locked into this expanded position by mating locking surfaces 47C and 53C, 119 and 121, and 123 and 125, and with the release ring 42C located in a recess 116 in the lower most key shoulder 24C of locking support element 16C which in this case does not transmit any load to the outer hanger 12C. In the design shown in FIG. 3C, radial distances "a", "C", "B", "d" and "t" are the same as those shown in FIG. 3B while "e" is equal to "a". However, there are six grooves with load bearing shoulders in the outer hanger body 12C and six corresponding load bearing shoulders (including shoulder 54) with locking surfaces on the inner hanger body 10C and the locking support element 16C has internal and external load bearing shoulders that mate with all of these shoulders thereby providing twice the load bearing surface area as shown in FIG. 3B and thus twice the load carrying capacity. Although six sets of load bearing shoulders are shown in FIG. 3C, it is apparent that the number could be varied to provide any desired load carrying capacity. The load carrying capacity of the invention shown in FIG. 3C could also be increased about fifty percent by increasing the radial distance "t" to "T" (FIG. 3A) thereby permitting a corresponding increase in load bearing surface areas.

The present invention therefore provides a well suspension system which increases the load carrying capacity by providing two or more load bearing shoulders and locking surfaces between the inner member 10 and the locking support element 16 and two or more load bearing shoulders between the locking support element 16 and the outer member 12. The load bearing shoulders may be formed by individual circular or continuous single or multiple helical surfaces.

Referring now to FIGS. 4A and 4B, an alternate design for the locking support element 16, shown as 16D, consists of multiple individual nested units which when nested together provide an assembly that functions like one piece locking support element 16. As shown in FIGS. 4A and 4B, the top ring 140 and bottom ring 142 are different from the intermediate rings 144. Each ring contains the load bearing shoulders to mate with the shoulders in the outer hanger body 12 and on the inner hanger body 10. In addition, each upper ring has an inner downwardly protruding tang 146 that mates on the inside of an upwardly protruding tang 148 on each lower ring. The length of these tangs is such that they will remain engaged even if two adjacent rings are separated as far as possible when installed on the inner hanger body 10. This design permits the number of support shoulders on the locking support element 16D to be easily varied. FIG. 4B is an exploded view of the locking support element assembly 16D showing how the individual rings can be stacked and the number of intermediate rings varied to provide any desired number of support shoulders on the locking support element assembly 16D. If desired, the rings can be keyed to permit orientation with respect to each other.

The locking support element 16D in FIG. 4B has slots 150 milled longitudinally on its outside surface. These slots provide a by-pass for fluid flow and also permit varying the spring force of the support element. This same construction can be used in a single piece locking support element 16 as shown in FIG. 1. In addition, longitudinal slots may be milled on the outside of the hanger body 10 as shown by the dotted line 152 in FIGS. 4A and 1 in order to provide an additional bypass for fluid flow.

Figure 6:
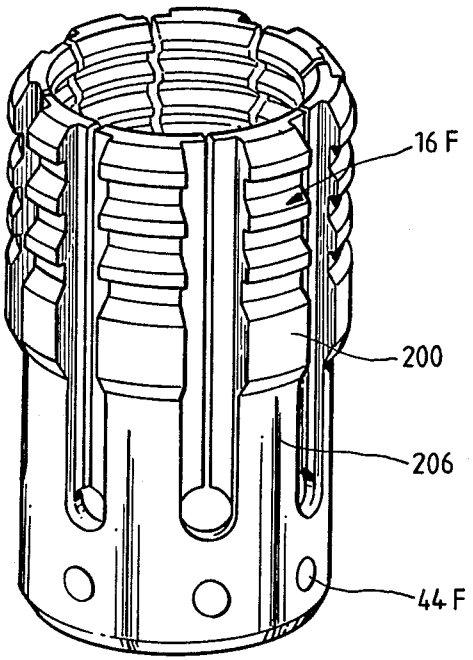
FIG. 6 is a perspective elevational view of still another locking support element design of the present invention where collet fingers provide the outward radial bias for the locking support elements and also includes the release means to permit axial movement of the locking support element with respect to the inner hanger body.
Figure 5:
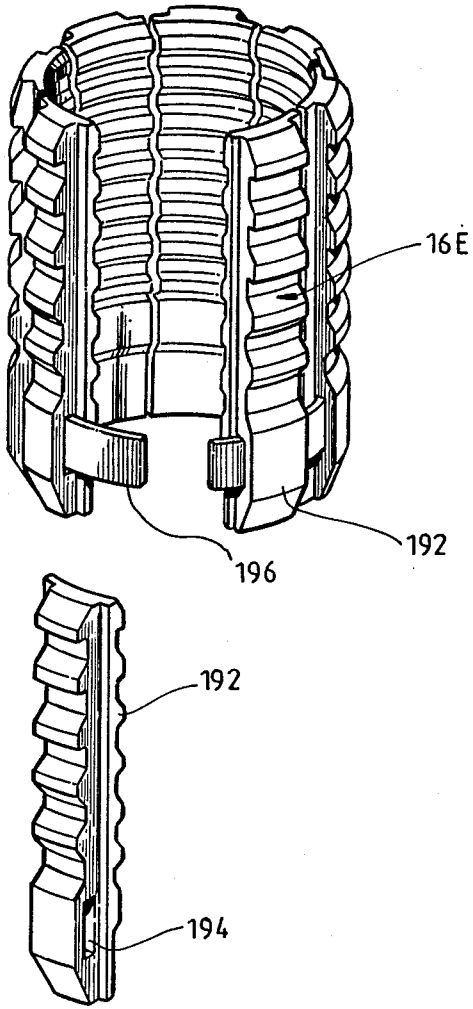
FIG. 5 is a perspective, partly exploded, elevational view of an alternate locking support element construction consisting of multiple individual elements or dogs attached to a circular C-shaped spring that supports the multiple elements and also provides the outward radial bias for the elements.

Referring now to FIGS. 5 and 6, still other alternate designs for locking support element 16 are shown. The locking support element 16E shown in FIG. 5 consists of individual elements 192, each of which has a groove or slot 194 through which a support spring 196 may be passed. Thus the individual elements 192 are held together on the support spring 196 which also provides a radial outward bias force on each element. This locking support element 16E functions in the same fashion as the element 16 shown in FIGS. 1, 2A, 2B and 2C. The individual elements 192 could also be contained in a cage and have individual spring elements to drive them outward.

FIG. 6 shows still another design for a locking element shown as 16F, where the outward radial bias on the individual locking elements 200 is provided by a collet-spring force acting through spring fingers 206. This collet design may include the same release means as shown in FIGS. 2A, 2B, 2C and 3C, or if desired, the shear pins 44F may be installed directly in the base of the collet design shown in FIG. 6.

The present invention, therefore, is well adapted to carry out the objects and attain the ends and advantages mentioned as well as others inherent therein. While presently preferred embodiments of the invention are given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. An assembly for connecting an inner and an outer tubular member to and from each other in a well by longitudinal movement of the inner member comprising, said inner member having two or more radial outwardly extending load bearing shoulders positioned on the outer surface of the inner member, an outwardly spring biased and resiliently expandable and contractible locking support element positioned and axially slidable on the outer surface of the inner member and having inwardly extending load bearing shoulders that mate with each of the corresponding load bearing shoulders on the inner tubular member, two or more radial outwardly extending load bearing shoulders on said locking support element, said outer tubular member having a non-restrictive bore including mating load bearing surfaces in recessed circumferential grooves for receiving the outwardly spring biased outwardly extending load bearing shoulders on said locking support element, release means connected to the inner member for preventing upward axial movement of the locking support element on the inner member until after the outwardly extending load bearing shoulders on the locking support element have engaged the mating load bearing surfaces in the circumferential grooves in the outer member and a predetermined load has been applied on the release means after which the inner member moves axially downwardly in the expanded locking support element forcing it into an expanded position and into engagement with the load bearing shoulders on the inner tubular member and the load bearing surfaces of the outer tubular member.

2. The apparatus of claim 1 wherein the inner member includes one or more vertically extending locking surfaces on its outer surface that mate with mating locking surfaces on the inner surface of the locking support element.

3. The apparatus of claim 1 wherein the release means consists of a shearable element.

4. The apparatus of claim 1 wherein said locking support element and said outer tubular member include a longitudinal axis and at least one of the outwardly extending load bearing shoulders on the locking support element and one of the mating load bearing surfaces on the outer tubular member is substantially at right angles to said longitudinal axis.

5. The apparatus of claim 1 wherein the locking support element consists of a circular ring cut longitudinally in one place to permit radial flexing of the said locking support element.

6. The apparatus of claim 5 wherein the locking support element consists of multiple separate circular rings, stacked longitudinally.

7. The apparatus of claim 1 wherein the locking support element consists of multiple individual longitudinally positioned elements connected together and spring biased outwardly.

8. The apparatus of claim 1 wherein the locking support element includes top and bottom surfaces which are tapered inwardly.

* * * * *